US007481382B2

(12) United States Patent
Christ

(10) Patent No.: US 7,481,382 B2
(45) Date of Patent: Jan. 27, 2009

(54) OUTLET HOOD FOR A DEVICE FOR SPRAYING A HIGHLY VISCOUS LIQUID

(75) Inventor: Stefan Christ, Hochheim (DE)

(73) Assignee: AERO Pump GmbH, Zerstäuberpumpen, Hochheim/Main (DE)

( * ) Notice: Subject to any disclaimer, the term of this patent is extended or adjusted under 35 U.S.C. 154(b) by 319 days.

(21) Appl. No.: 11/367,148

(22) Filed: Mar. 3, 2006

(65) Prior Publication Data

US 2006/0213408 A1 Sep. 28, 2006

(30) Foreign Application Priority Data

Mar. 5, 2005 (DE) ..... 10 2005 010 173

(51) Int. Cl.
*B05B 1/18* (2006.01)

(52) U.S. Cl. ..... 239/567; 239/333; 239/337; 239/548; 239/552; 239/596; 239/490; 239/601

(58) Field of Classification Search ..... 239/337, 239/280, 532, 548, 558, 567, 552, 559, 333, 239/490, 596, 601
See application file for complete search history.

(56) References Cited

U.S. PATENT DOCUMENTS 87,321 A * 3/1869 Barrows ..... 239/558
2,874,001 A * 2/1959 Webb ..... 239/533.14
6,758,422 B2 * 7/2004 Kuo ..... 239/596

FOREIGN PATENT DOCUMENTS

| | | |
|---|---|---|
| DE | 1 953 024 | 10/1970 |
| DE | 38 28 111 | 6/1991 |
| DE | 195 25 988 | 1/1997 |
| DE | 202 12 798 | 1/2003 |
| DE | 102 31 751 | 7/2004 |
| DE | 103 21 902 | 12/2004 |
| FR | 2 067 520 | 11/1969 |
| GB | 559 935 | 11/1943 |
| GB | 2 283 441 | 5/1995 |
| WO | 2004/043608 | 5/2004 |

* cited by examiner

*Primary Examiner*—Dinh Q Nguyen
(74) *Attorney, Agent, or Firm*—Friedrich Kueffner

(57) ABSTRACT

An outlet hood (1) for mounting at an end of an outlet duct (3) of a spraying device for highly viscous or gel-like media. The bottom (7) of the outlet hood (1) has a uniform thickness and is provided with outlet openings (8) which diverge relative to each other. The bottom of the outlet hood (1) is outwardly arched and the outlet openings (8) have a uniform cross section over their entire length which corresponds to the thickness of the bottom (7), and the outlet openings (8) are arranged distributed over the bottom (7).

13 Claims, 1 Drawing Sheet

OUTLET HOOD FOR A DEVICE FOR SPRAYING A HIGHLY VISCOUS LIQUID

BACKGROUND OF THE INVENTION

1. Field of the Invention

The present invention relates to an outlet hood for mounting at an end of an outlet duct of a spraying device for highly viscous or gel-like media. The bottom of the outlet hood has a uniform thickness and is provided with outlet openings which diverge relative to each other.

2. Description of the Related Art

Highly viscous or gel-like media are not capable of forming aerosols. For example, they may be personal cleaning agents, medicines, gels, or oils. Such media cannot be uniformly applied in the form of a spray cone composed of fine droplets onto a surface by means of a conventional spraying device which is suitable for low-viscosity liquids.

DE 103 21 902 A1 discloses a spraying device with an outlet hood of the above-described type in which a plurality of diverging outlet openings are formed in the pattern of the outlet hood. Where, the outlet ends of all outlet openings are located on a circle. The ejected jets form a hollow spray cone. In order to facilitate an approximately uniform spray on a surface, it is necessary to move the spraying device accordingly. Moreover, the outlet openings become smaller toward their outlet ends, and they have an approximately rectangular cross-section. The manufacture of such outlet openings is difficult.

SUMMARY OF THE INVENTION

Therefore, it is the primary object of the present invention to provide an outlet hood of the above-described type which is easy to manufacture and facilitates the manipulation of a spraying device equipped with the outlet hood.

In accordance with the present invention, the bottom of the outlet hood is outwardly arched and the outlet openings have a uniform cross section over their entire length which corresponds to the thickness of the bottom, and the outlet openings are arranged distributed over the bottom.

As a result of the configuration according to the present invention, the outlet openings can be of simpler construction because of their uniform cross-section. The uniform cross-section makes it possible to provide a large number of outlet openings with a small cross-sectional area. Consequently, in comparison to the above-described outlet hood, the outlet openings can be arranged relatively closely together, while the strength of the bottom of the outlet hood remains the same. This configuration results in a correspondingly large number of thin spray jets which, in connection with the distribution of the outlet openings over the bottom of the outlet hood result in an essentially uniform sprayed surface, without having to move the spraying device equipped with the outlet hood relative to the surface to be sprayed.

A particularly simple manufacture of the outlet hood is possible if the bottom is made of a flat plate which is provided with the outlet openings perpendicularly of the plane thereof, and which is pressed into the arched shape. In this configuration, all outlet openings are provided so as to extend under the same right angle relative to the plane of the plate. The diverging directions of the outlet openings results in a simple manner from the repassing of the plate into the arched shape.

The outlet openings can be formed in a simple manner by means of laser rays. This makes it possible to not only arrange the outlet openings relatively close together but also to construct the outlet ducts very thin.

In accordance with an alternative feature, the outlet openings can also be formed by an etching method.

For example, it is possible that the cross-section of the outlet openings is round and the cross-section is in the range of 5 to 50 micrometers.

The bottom may be of synthetic material. However, metal is preferred. The bottom can then be manufactured relatively thin while still having sufficient strength, wherein the bottom can be easily deformed in the cold state in order to provide the arched shape.

A cylindrical wall extending in the opposite arched direction may be protruding from the edge of the bottom. The cylindrical shape of the wall can be manufactured easily.

The wall may also be manufactured of metal. However, the wall may preferably be comprised of thermoplastic material. The plastic material makes it possible to injection mold the edge of the bottom in a simple manner by injection molding in a molding tool having the cylindrical wall in order to connect the bottom and the wall.

In accordance with an alternative feature, the cylindrical wall can also be prefabricated and the bottom may be fastened by a press fit in the one edge of the cylindrical wall.

In addition, at least the bottom may be coated on its inner side with an oligodynamic substance. Such a substance has a sterilizing effect and kills the germs which are contained in a residue of the medium which remains in the outlet hood after the spraying device has been used, wherein the remainder of the medium has been contaminated after some time prior to the next use of the spraying device.

The inner side of the cylindrical wall may also be coated with the substance. The effect of the substance increases with increasing size of the coated surface.

The substance may contain a heavy metal. This substance can be applied in the simplest manner on a metal bottom. The heavy metal is preferably silver. Gold or tin would also be possible.

The silver may be alloyed with copper.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 1:
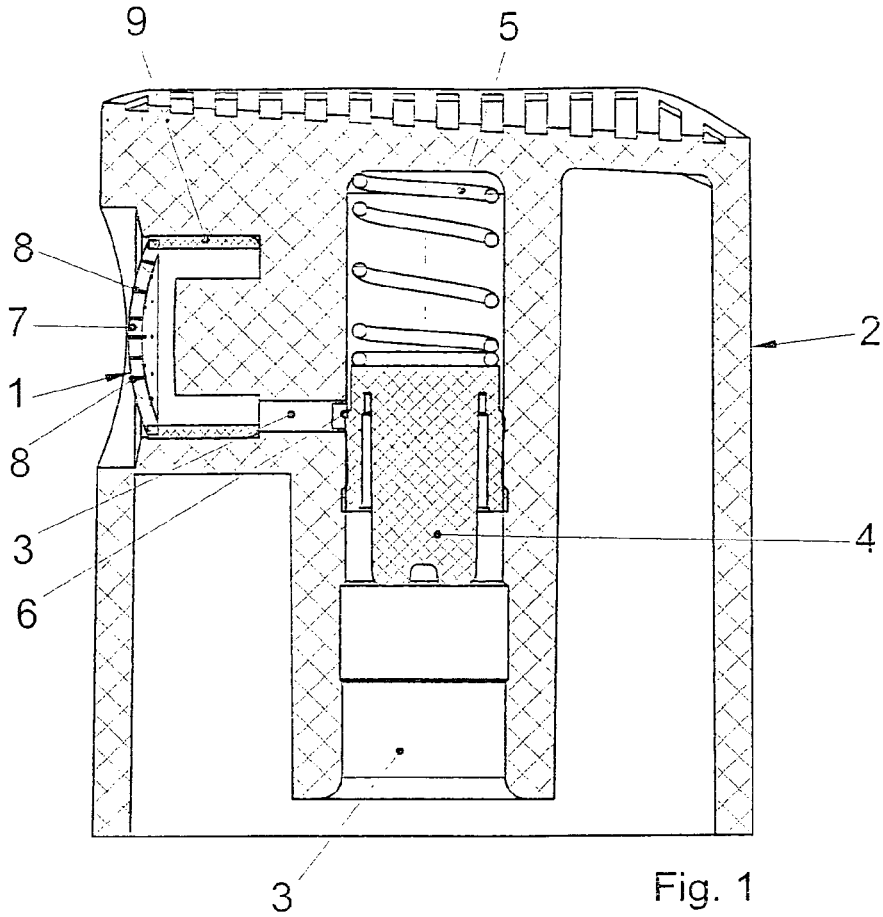
FIG. 1 is an axial sectional view of an actuating head of a conventional spraying device which, however, is provided with an outlet hood according to the present invention.
Figure 2:
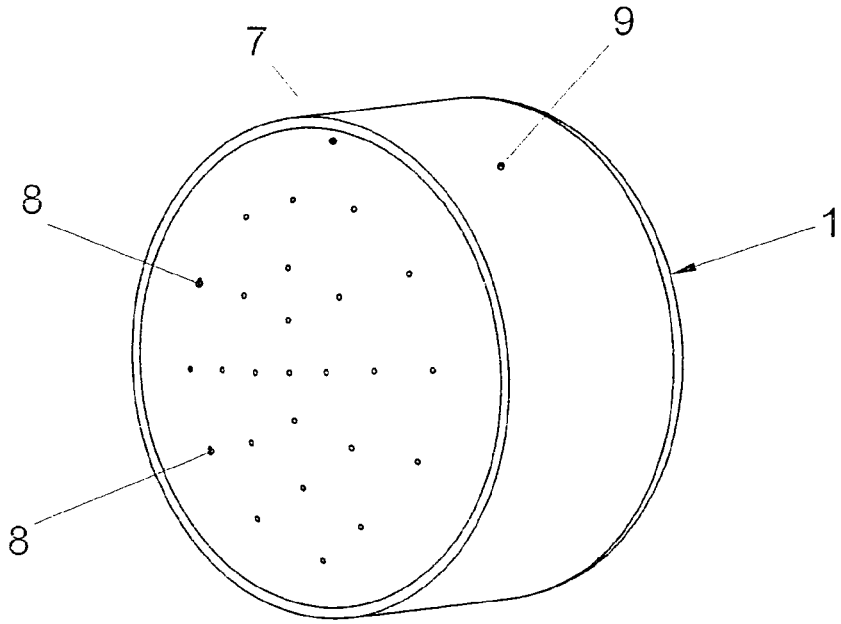
FIG. 2 is a perspective view, on a larger scale of the outlet hood.

FIG. 1 of the drawing shows an outlet hood 1 according to the present invention, with an actuating hood 2 of a spraying device as it is known from DE 102 31 751 B4. The outlet hood is mounted at the end of an outlet duct 3. While the known spraying device is suitable for spraying a low-viscosity liquid in the form of an aerosol, the outlet hood 1, which is used instead of the known spraying insert with turbulence chamber in the actuating head 2, facilitates spraying of a highly viscous or gel-like medium, for example, a personal cleaning agent, medicine, gel or oil, by manually exerting a pressure on the actuating head 2 which presses the medium from the container of the spraying device into the outlet duct 3 against a valve closing member 4 which is movable in the outlet duct 3, and which is then pushed against the force of a spring 5 into the open position relative to an opening 6 in the outlet duct 3, so that the medium can exit through the outlet hood 1.

In order to be able to spray the medium uniformly on a surface, a uniformly thick bottom 7 of the outlet hood 1 which is arched outwardly is provided with essentially uniformly distributing outlet openings 8 which are directed perpendicularly of its inner and outer sides. The arch shape is preferably spherical. Consequently, the outlet openings diverge relative to each other in accordance with the curvature of the arch shape of the bottom 7. The outlet openings have over the length thereof corresponding to the thickness of the bottom 7 a uniformly round cross-section and are located relatively close together. The bottom 7 has been manufactured by initially providing a flat round plate of metal, in the present case brass, with outlet openings 8 which extend perpendicularly of the plane of the plate, and then pressing the plate in the cold state into the arched shape. This deformation of the plate simultaneously results in the outlet openings 8 extending so as to diverge relative to each other.

The outlet openings have been formed by means of a laser ray. However, the outlet ducts can also be formed by etching of the plate. In this case, a lithographic coating of the plate with a medium which is resistant to the etching medium is provided, wherein the locations of the plate which are not to be provided with outlet openings are not coated and the medium is removed after the locations have been etched.

The bottom 7 is at its edge injection molded with an edge of a cylindrical wall of thermoplastic material, for example, POM (polyoximethylene) or PP (polypropylene).

In accordance with an alternative feature, the bottom 7 may be fastened in the edge of the cylindrical wall 9 by a press fit.

The cylindrical wall 6 may also consist of plastics material instead of metal.

The container 7 may alternatively be of plastics material.

The bottom, and preferably also the cylindrical wall 9, are on their insides coated with an oligodynamic substance, not shown, which has a sterilizing and germ-killing effect, in order to prevent a residue of the sprayed medium which has remained in the outlet hood 1 after the spraying device has been used from being contaminated with bacteria and/or harmful germs prior to a later repeated use of a spraying device. The substance contains an appropriate heavy metal; in the described embodiment the heavy metal is silver or an alloy of silver and copper. In accordance with an alternative feature, gold or tin can also be used.

Preferably, but not necessarily, the bottom 7 is composed of metal, as is the cylindrical wall 9, because metal is more easily galvanically coatable with a metal.

The described shape of the outlet hood 1 is not only easily manufactured, but also makes it possible to uniformly spray a limited surface, for example, of a relatively small part of the human skin or an eye, by means of a highly viscous or gel-like medium in the form of a spray cone composed of essentially uniformly distributed jets of the medium, without having to move the spraying device equipped with the outlet hood relative to the surface to be sprayed, as long as the surface is not greater than the cross-section of the spray cone and the outlet hood is positioned at an appropriate distance from the surface to be sprayed.

While specific embodiments of the invention have been shown and described in detail to illustrate the inventive principles, it will be understood that the invention may be embodied otherwise without departing from such principles.

I claim:

1. An outlet hood (1) for mounting at an end of an outlet duct (3) of a spraying device for highly viscous or gel-like media, wherein the outlet hood (1) comprises a bottom (7) having a uniform thickness and provided with outlet openings (8) which diverge relative to each other, wherein the bottom (7) is outwardly arched and the outlet openings (8) have over an entire length thereof which corresponds to the thickness of the bottom (7) a uniform cross section, and wherein the outlet openings (8) are uniformly distributed over the bottom (7), wherein the outlet openings (8) have a round cross section, and wherein the cross section diameter is between 5 and 50 micrometers.

2. The outlet hood (1) according to claim 1, wherein the bottom (7) is comprised of a flat plate which is provided perpendicularly relative to a plane of the bottom (7) with the outlet openings (8) and wherein the bottom (7) has been pressed into an arch shaped.

3. The outlet hood (1) according to claim 1, wherein the outlet openings (8) are manufactured by laser rays.

4. The outlet hood (1) according to claim 1, wherein the bottom (7) comprises metal.

5. The outlet hood (1) according to claim 1, wherein the bottom (7) has a rim and a cylindrical wall (9) protruding from the rim of the bottom (7) in the direction opposite the arched direction.

6. The outlet hood (1) according to claim 5, wherein the cylindrical wall (9) is of thermoplastic material.

7. The outlet hood (1) according to claim 6, wherein the rim of the bottom (7) is injection molded with the cylindrical wall (9).

8. The outlet hood (1) according to claim 5, wherein the bottom is mounted by a press fit in a rim of the cylindrical wall (9).

9. The outlet hood (1) according to claim 1, wherein at least the bottom (7) is coated on an inner side thereof with an oligodynamic substance.

10. The outlet hood (1) according to claim 9, wherein an inner side of the cylindrical wall (9) is coated with the substance.

11. The outlet hood (1) according to claim 9, wherein the substance comprises a heavy metal.

12. The outlet hood (1) according to claim 11, wherein the heavy metal is silver.

13. The outlet hood (1) according to claim 9, wherein the substance comprises an alloy of silver and copper.

* * * * *